US006393844B1

(12) United States Patent
Kirkconnell et al.

(10) Patent No.: US 6,393,844 B1
(45) Date of Patent: May 28, 2002

(54) PULSE TUBE EXPANDER HAVING A POROUS PLUG PHASE SHIFTER

(75) Inventors: Carl S. Kirkconnell, Huntington Beach; Kenneth D. Price, Long Beach; William E. Croft, Van Nuys; Alberto E. Schroth, Mission Hills, all of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/643,440

(22) Filed: Aug. 22, 2000

(51) Int. Cl.[7] ..... F25B 9/00
(52) U.S. Cl. ..... 62/6; 60/520
(58) Field of Search ..... 62/6, 908; 60/520

(56) References Cited

U.S. PATENT DOCUMENTS

| | | | | |
|---|---|---|---|---|
| 2,576,610 A | | 11/1951 | Kunzog | |
| 4,711,650 A | | 12/1987 | Faria et al. | 62/6 |
| 4,770,032 A | * | 9/1988 | Plentovich et al. | 73/147 |
| 4,846,861 A | | 7/1989 | Berry et al. | |
| 5,097,866 A | | 3/1992 | Shapiro-Baruch et al. | |
| 5,269,147 A | * | 12/1993 | Ishizaki et al. | 62/6 |
| 5,284,519 A | | 2/1994 | Gadgil | |
| 5,335,505 A | * | 8/1994 | Ohani et al. | 62/6 |
| 5,613,365 A | | 3/1997 | Mastrup et al. | 62/6 |
| 5,647,219 A | | 7/1997 | Rattray et al. | 62/6 |
| 5,791,149 A | | 8/1998 | Dean | |
| 5,875,651 A | * | 3/1999 | Hill et al. | 62/511 |
| 6,021,643 A | | 2/2000 | Gardner et al. | |
| 6,082,117 A | | 7/2000 | Funatsu et al. | |

OTHER PUBLICATIONS

Zhou, Y et al.: The Influence of Check Valve With a Filter on the Performance of Pulse Tue Refrigerators, Advances in Cryogenic Engineering, 7–17–21, 1995, pp. 1449–1454.

* cited by examiner

*Primary Examiner*—Ronald Capossela
(74) *Attorney, Agent, or Firm*—Colin M. Raufer; Leonard A. Alkov; Glenn H. Lenzen, Jr.

(57) ABSTRACT

A pulse tube expander includes a regenerator, a pulse tube, a porous plug phase shifter, and a surge tank, in series gaseous communication with each other. The porous plug phase shifter is made of a porous material such as a sintered mass or a packed solid bed of distinct, free-flowing bodies. The porous plug phase shifter introduces a phase shift between the pressure wave and the mass flow rate in the pulse tube expander. The porous plug phase shifter is resistant to clogging due to contamination that may be present in the system.

19 Claims, 3 Drawing Sheets

PULSE TUBE EXPANDER HAVING A POROUS PLUG PHASE SHIFTER

This invention relates to pulse tube expanders and, more particularly, to a phase shifter that is highly resistant to plugging.

BACKGROUND OF THE INVENTION

Some types of sensors and electronic devices are not practically operable at temperatures above about 50–75 K and therefore must be cooled into this temperature range or below for proper operation. The cooling into this midcryogenic range is readily accomplished in some settings, such as a laboratory or a stationary service application, using a reservoir of a cryogenic fluid. In field operations, however, it is often not practical to supply a reservoir of the cryogenic fluid, and thermodynamic-cycle cooling devices are used.

Several types of thermodynamic-cycle cooling devices are known. One such cooler is the pulse tube expander, based upon a modified Stirling cycle, in which pressurized gas in a regenerator/pulse tube assembly is rapidly pulsed such that compression work is done in the warm region of the assembly to remove heat from the expander, and expansion work is done in the cold region to absorb a thermal load. The phase angle between the pressure wave and the mass flow wave is controlled by a small-diameter orifice or a long, small-diameter tube ("inertance tube") located in the gas flow path between a rejection heat exchanger of the pulse tube and a surge tank. Pulse tube refrigeration devices are reasonably efficient, have minimal vibration, are dependable over long service lives, and are of moderate cost. The present invention deals with a cooling system utilizing an improved form of the pulse tube expander.

The present inventors have observed that the operation of the pulse tube expander may be adversely affected by the unavoidable presence of some types of contamination of the working gas. This contamination first reduces the efficiency of the pulse tube expander, and eventually renders it inoperable. There is a need for an understanding of the source of this effect and a solution to the problem of degradation of performance due to the contamination. The present invention fulfills this need, and further provides related advantages.

SUMMARY OF THE INVENTION

The present invention provides a pulse tube expander which is fully functional but which has reduced sensitivity to the presence of contamination in the working gas.

In accordance with the invention, a pulse tube expander operable with a pressure source comprises a group of components in gaseous series relation with each other. A regenerator has a regenerator inlet in gaseous communication with the pressure source, and a regenerator outlet. (As used herein, "gaseous communication" includes either a direct gaseous communication or an indirect gaseous communication through an intermediate component such as a heat exchanger.) A pulse tube has a pulse-tube inlet in gaseous communication with the regenerator outlet, and a pulse-tube outlet. A constriction structure that serves as a gaseous phase shifter has a constriction structure inlet in gaseous communication with the pulse-tube outlet, and a constriction structure outlet. The constriction structure comprises at least two independent passageways therethrough extending from the constriction structure inlet to the constriction structure outlet. The constriction structure preferably comprises a porous plug phase shifter with a plurality of independent passageways therethrough extending from the constriction structure inlet to the constriction structure outlet. A surge tank has a surge-tank inlet in gaseous communication with the constriction structure outlet. The pulse tube expander typically includes heat exchangers in the gas flow path, such as a first heat exchanger between the pressure source and the regenerator, a second heat exchanger between the regenerator and the pulse tube, and/or a third heat exchanger between the pulse tube and the constriction structure.

The preferred porous plug constriction structure may take any of a variety of forms. For example, it may be a sintered mass or a packed solid bed of distinct, free-flowing bodies. If the latter, the distinct, free-flowing bodies are preferably non-particulating and non-settling, so that the properties of the porous plug do not change over time. The porous plug is most readily constructed as a tube filled with a porous solid mass. Examples include a tube filled with a plurality of distinct, free-flowing (before placing into the tube) bodies or a tube filled with a plurality of distinct, free-flowing (before placing into the tube) balls. The porous plug sintered mass or free-flowing bodies may be made of any operable material, examples being copper, aluminum, stainless steel, a lead-antimony alloy, glass, or a ceramic.

The sensitivity of the conventional pulse tube expander to contaminants has been traced to the partial or complete blocking of the orifice or the inertance tube by solid matter deposited in this confined cross-sectional area from the gas phase. For some multi-stage applications, the phase shifter operates at cryogenic temperatures. Either solid particulate or condensable gases (such as water vapor) may serve as the contaminant that blocks the orifice or inertance tube in these types of multi-stage applications. The blockage alters the gas flow so that the pulse tube expander loses its calibrated performance or becomes blocked entirely. The inertance tube is more resistant than the orifice to such blockage due to its larger cross-sectional area, but it is also subject to loss of performance and blockage due to contamination.

The multi-path constriction structure of the present invention provides a number of independent passageways extending from the constriction structure inlet to the constriction structure outlet. If one of the passageways becomes partially or fully blocked, gas flow continues in the other passageways. The constriction structure is most conveniently implemented by the use of a porous plug. The porosity may be produced in any operable fashion, and a number of examples are given herein.

The present approach reduces the sensitivity of the pulse tube expander to degradation as a result of contamination by particulates and/or a condensable phase. It is readily implemented to produce the desired constriction performance, with little added weight or size.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
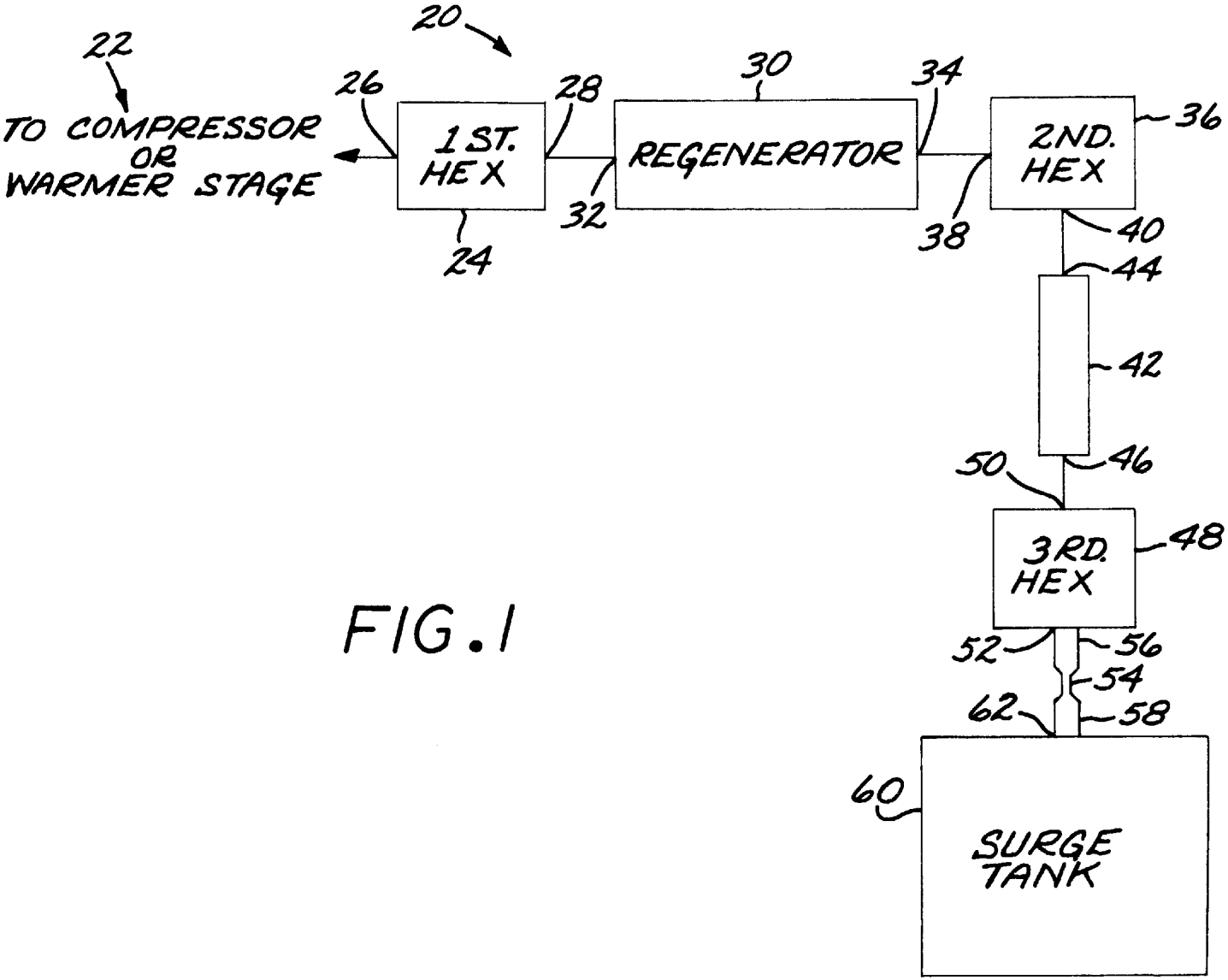
FIG. 1 is a schematic block diagram of a conventional pulse tube expander.

FIG. 1 depicts a pulse tube expander 20 operable with a pressure source 22. The pressure source 22 may be a compressor or a warmer stage of a cooling device, or any other pulsing pressure source. The pressure source 22 is not itself part of the present invention.

An idealized conventional pulse tube expander 20 includes a first heat exchanger 24, sometimes termed an inlet heat exchanger, having a first-heat-exchanger inlet 26 in gaseous communication with the pressure source 22, and a first-heat-exchanger outlet 28. (The terms "inlet" and "outlet" are used for convenience relative to gas flow from the pressure source 22. Gas flows in both directions through the pulse tube expander 20.) A regenerator 30 has a regenerator inlet 32 in gaseous communication with the first-heat-exchanger outlet 28, and a regenerator outlet 34. A second heat exchanger 36, sometimes termed a cold heat exchanger, has a second-heat-exchanger inlet 38 in gaseous communication with the regenerator outlet 34, and a second-heat-exchanger outlet 40. A pulse tube 42 has a pulse-tube inlet 44 in gaseous communication with the second-heat-exchanger outlet 40, and a pulse-tube outlet 46. A third heat exchanger 48, sometimes termed a rejection heat exchanger, has a third-heat-exchanger inlet 50 in gaseous communication with the pulse tube outlet 46, and a third-heat-exchanger outlet 52. A calibrated orifice 54 has a calibrated orifice inlet 56 in gaseous communication with the third-heat-exchanger outlet 52, and a calibrated orifice outlet 58. The calibrated orifice 54 is a precisely sized small single orifice, whose size may be varied to tune the performance of the pulse tube expander 20. A surge tank 60 has a surge-tank inlet 62 in gaseous communication with the orifice outlet 58. A long tube having a small inner diameter, termed an inertance tube, is not pictured but may be used instead of the calibrated orifice 54.

Details of the physical structures of some typical conventional pulse tube expanders are set forth, for example, in U.S. Pat. Nos. 5,647,219; 5,613,365; and 4,711,650.

The inventors have observed degraded performance under some circumstances when using the pulse tube expander structure discussed in relation to FIG. 1. They have traced this degraded performance to partial or total obstruction of the calibrated orifice 54 or the inertance tube. The inventors have also identified plugging of the orifice due to condensable contaminants as a likely failure mode for certain multi-stage expander designs.

Figures 2, 3:
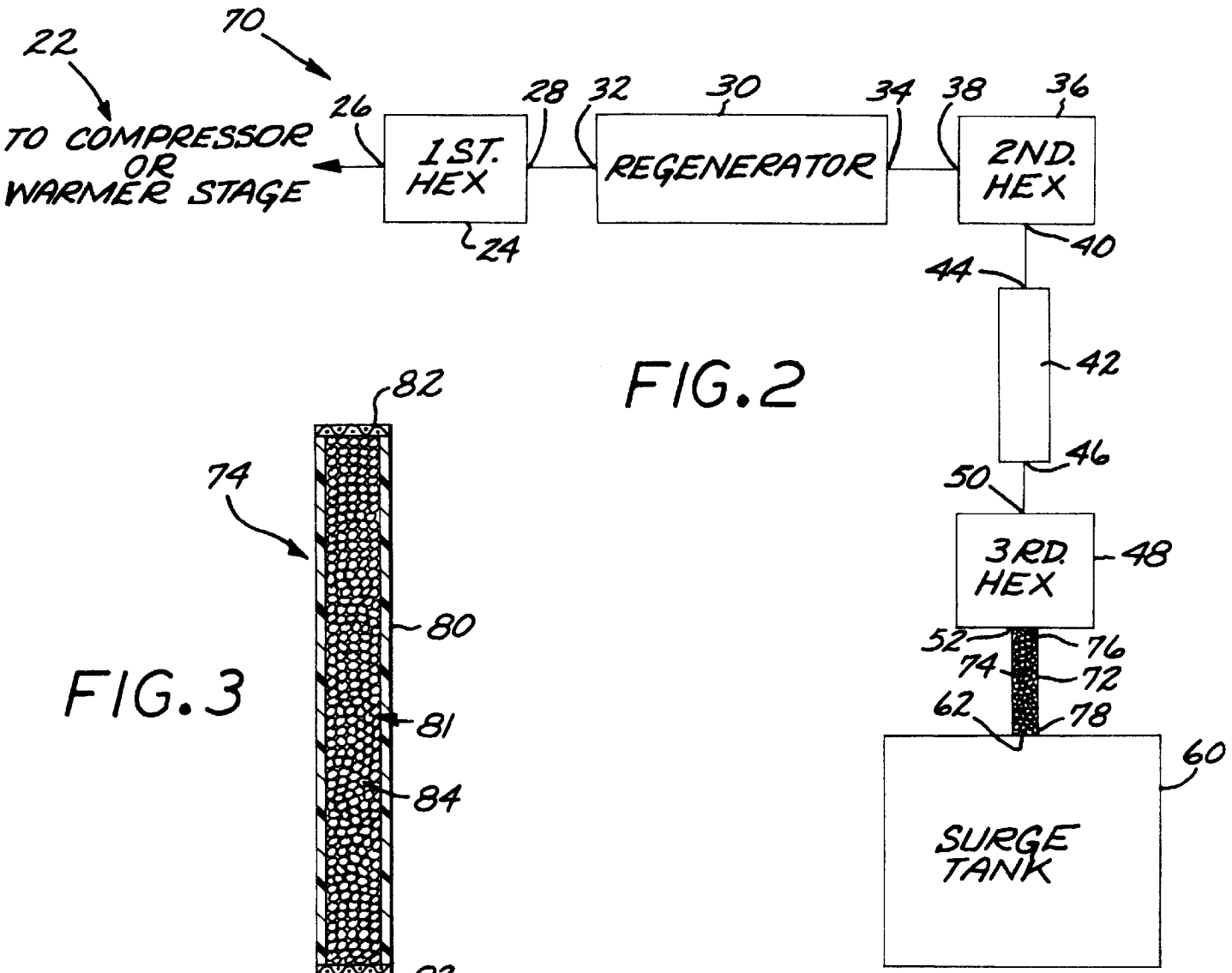
FIG. 2 is a schematic block diagram of a pulse tube expander according to the invention.
FIG. 3 is a sectional view of a porous plug phase shifter.

In an embodiment in accordance with the present invention, a pulse tube expander 70, illustrated schematically in FIG. 2, has many of the same components as the pulse tube 20 of FIG. 1. The same nomenclature and reference numerals have been applied where appropriate in FIG. 2, and the prior description of those elements of structure is incorporated here.

The primary difference between the approach of FIG. 2 and that of FIG. 1 is that the calibrated orifice 54 is replaced with a constriction structure 72 having a constriction structure inlet in gaseous communication with the pulse-tube outlet, and a constriction structure outlet. The constriction structure 72 comprises at least two independent passageways therethrough extending from the constriction structure inlet to the constriction structure outlet.

A preferred form of the constriction structure 72 is illustrated in FIG. 2. The preferred constriction structure 72 comprises a porous plug 74 having a porous-plug inlet 76 in gaseous communication with the pulse-tube outlet 46 (in this case indirectly through the third heat exchanger 48), and a porous-plug outlet 78. The surge-tank inlet 62 is in communication with the porous-plug outlet 78.

The constriction structure 72 and its porous plug 74 embodiment provide at least two, and preferably a plurality of, passageways through which the gas pressure wave and mass flow are transmitted. If one or a few of the passageways are blocked by particulate or condensable contaminant, the remaining parallel (in a mass or pressure flow sense) passageways remain open and the functionality of the structure is not impaired.

The porous plug 74 may take any of a variety of forms. The porous plug 74 may be a sintered mass of material. The sintering is incomplete so that the relative density is less than 1, leaving an open-cell network of interconnected porosity extending through the sintered mass. The porous plug may instead comprise a packed solid bed of distinct, free-flowing bodies 84. The term "distinct, free-flowing" means that the bodies would pour out of an inverted container. In this case, the distinct, free-flowing bodies 84 are non-particulating so that over time when in service they do not form clumps that would alter the flow characteristics. The distinct, free-flowing bodies 84 are also non-settling, so that over time when in service they do not form a stratified structure from the fluidizing action of the gas pressure and mass flow, which stratified structure would also alter the flow characteristics. The porous plug 74 is made of any operable material, with preferred examples being copper, aluminum, stainless steel, a lead-antimony alloy, glass, and/or a ceramic.

Most preferably and as illustrated in FIG. 3, the porous plug 74 comprises a tube 80 filled with a porous solid mass 81. The tube 80 physically contains and confines the porous solid mass 81 and also prevents gas leakage outwardly from the sides of the porous solid mass. The tube 80 may be filled, for example, with the sintered material that acts as the porous solid mass 81. FIG. 3 illustrates the tube 80 filled with the plurality of distinct, free-flowing bodies 84 that together serve as the porous solid mass 81. In this case, the distinct, free-flowing bodies 84 are generally spherical balls. To retain the distinct, free-flowing balls in the tube 80, a screen 82 (which may be one screen or more than one screen in a screen pack) is placed over each end of the tube 80. The screen 82 has a mesh size smaller than the bodies contained within the tube 80.

The gas-pressure-transmission and mass-flow properties of the porous plug 74 may be established over a wide range, an important advantage of the invention. The gas pressure transmission and mass flow properties are determined by the length and diameter of the porous plug 74, and by the hydraulic diameter of the porous material of the porous plug. That is, the size and nature of the porosity establish the flow impedance of the porous plug 74. By adjusting these parameters, the gas-pressure-transmission and mass-flow properties of the porous plug 74 are readily selected. The flow properties of the gas in the porous plug are approximately determined by the relation:

$$\Delta P=(fL/D_h)\rho V_a^2/2,$$

where ΔP is the pressure drop, f is the friction factor, which is a function of the Reynolds number and the porous plug geometry, L is the porous plug length, $D_h$ is the hydraulic diameter of the porous plug, ρ is the average gas density in the porous plug, and $V_a$ is the mean velocity of the gas flowing in the porous plug. This relation is integrated over the length of the tube at each time step.

Figure 4:
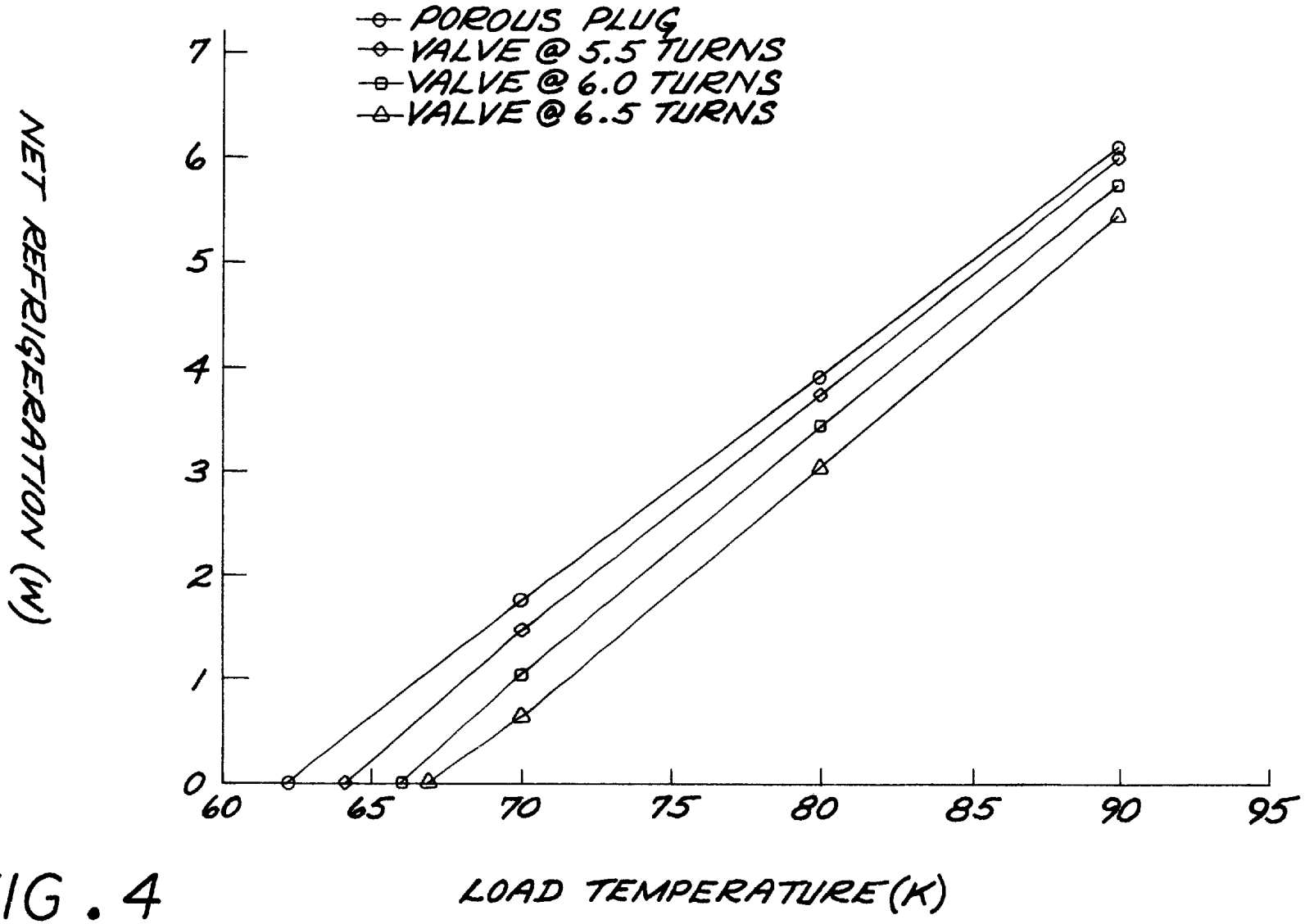
FIG. 4 is a graph of net refrigeration as a function of load temperature for the porous plug and for three conventional valve orifices.

The present invention has been reduced to practice using an existing pulse tube expander utilizing the porous plug of the invention, and in a separate demonstration utilizing a standard adjustable orifice valve. The porous plug was made of 0.020 inch diameter stainless steel balls packed into a tube having an inside diameter of 0.194 inch and a length of 1.68 inches, with 400 mesh wire screens retaining the balls in the tube. The performance obtained with the porous plug was better than that of the orifice valve at all settings tested. FIG. 4 shows the net refrigeration as a function of the load temperature, for the porous plug and for the conventional orifice valve in three settings of a variable orifice graded in "turns". The studies indicated that the porous plug approach is thermodynamically equivalent to or superior to the orifice valve approach when the system is optimized.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A pulse tube expander comprising:

a pressure source of a working gas having a contaminant therein, the contaminant being selected from the group consisting of a solid particulate and a condensable gas;

a regenerator having a regenerator inlet in gaseous communication with the pressure source, and a regenerator outlet;

a pulse tube having a pulse-tube inlet in gaseous communication with the regenerator outlet, and a pulse-tube outlet;

a porous plug having a porous-plug inlet in gaseous communication with the pulse-tube outlet, and a porous-plug outlet; and a surge tank having a surge-tank inlet in gaseous communication with the porous-plug outlet.

2. The pulse tube expander of claim 1, wherein the porous plug comprises a sintered mass.

3. The pulse tube expander of claim 1, wherein the porous plug comprises a packed solid bed of distinct, free-flowing bodies.

4. The pulse-tube expander of claim 3, wherein the distinct, free-flowing bodies are non-particulating.

5. The pulse-tube expander of claim 3, wherein the distinct, free-flowing bodies are non-settling.

6. The pulse tube expander of claim 1, wherein the porous plug comprises a tube filled with a porous solid mass.

7. The pulse tube expander of claim 1, wherein the porous plug comprises a tube filled with a plurality of distinct, free-flowing bodies.

8. The pulse tube expander of claim 1, wherein the porous plug comprises a tube filled with a plurality of distinct, free-flowing balls.

9. The pulse-tube expander of claim 1, wherein the porous plug is made of a material selected from the group consisting of copper, aluminum, stainless steel, a lead-antimony alloy, glass, and a ceramic.

10. A pulse tube expander comprising:

a pressure source of a working gas having a contaminant therein, the contaminant being selected from the group consisting of a solid particulate and a condensable gas that may condense under the operating conditions of the pulse tube expander;

a first heat exchanger having a first-heat-exchanger inlet in gaseous communication with the pressure source, and a first-heat-exchanger outlet;

a regenerator having a regenerator inlet in gaseous communication with the first-heat-exchanger outlet, and a regenerator outlet;

a second heat exchanger having a second-heat-exchanger inlet in gaseous communication with the regenerator outlet, and a second-heat-exchanger outlet;

a pulse tube having a pulse-tube inlet in gaseous communication with the second-heat-exchanger outlet, and a pulse-tube outlet;

a third heat exchanger having a third-heat-exchanger inlet in gaseous communication with the pulse tube outlet, and a third-heat-exchanger outlet;

a porous plug having a porous-plug inlet in gaseous communication with the third-heat-exchanger outlet, and a porous-plug outlet; and a surge tank having a surge-tank inlet in gaseous communication with the porous-plug outlet.

11. The pulse tube expander of claim 10, wherein the porous plug comprises a sintered mass.

12. The pulse tube expander of claim 10, wherein the porous plug comprises a packed solid bed of distinct, free-flowing bodies.

13. The pulse-tube expander of claim 12, wherein the distinct, free-flowing bodies are non-particulating.

14. The pulse-tube expander of claim 12, wherein the distinct, free-flowing bodies are non-settling.

15. The pulse tube expander of claim 10, wherein the porous plug comprises a tube filled with a porous solid mass.

16. The pulse-tube expander of claim 10, wherein the porous plug is made of a material selected from the group consisting of copper, aluminum, stainless steel, a lead-antimony alloy, glass, and a ceramic.

17. A pulse tube expander comprising:

a pressure source of a working gas having a contaminant therein, the contaminant being selected from the group consisting of a solid particulate and a condensable gas that may condense under the operating conditions of the pulse tube expander;

a regenerator having a regenerator inlet in gaseous communication with the pressure source, and a regenerator outlet;

a pulse tube having a pulse-tube inlet in gaseous communication with the regenerator outlet, and a pulse-tube outlet;

a constriction structure having a constriction structure inlet in gaseous communication with the pulse-tube outlet, and a constriction structure outlet, the constriction structure comprising at least two independent passageways therethrough extending from the constriction structure inlet to the constriction structure outlet; and a surge tank having a surge-tank inlet in gaseous communication with the constriction structure outlet.

18. The pulse tube expander of claim 17, wherein the constriction structure comprises a porous plug.

19. The pulse tube expander of claim 17, wherein the constriction structure comprises a plurality of independent passageways therethrough extending from the constriction structure inlet to the constriction structure outlet.

* * * * *